US005383803A

United States Patent [19]

Pilgrim

[11] Patent Number: 5,383,803

[45] Date of Patent: Jan. 24, 1995

[54] OUTBOARD MOTOR COOLING SYSTEM

[76] Inventor: David R. Pilgrim, P.O. Box 1927, Rockport, Tex. 78382

[21] Appl. No.: 126,694

[22] Filed: Sep. 17, 1993

Related U.S. Application Data

[63] Continuation of Ser. No. 15,141, Feb. 9, 1993, abandoned, which is a continuation of Ser. No. 625,003, Dec. 10, 1990, abandoned, which is a continuation-in-part of Ser. No. 481,249, Feb. 20, 1990, abandoned.

[51] Int. Cl.[6] ..... B63H 21/10

[52] U.S. Cl. ..... 440/88; 440/900

[58] Field of Search ..... 440/88, 89, 900; 114/284–287, 271; 123/196 R; 165/41, 44, 51

[56] References Cited

U.S. PATENT DOCUMENTS 4,350,010 9/1982 Yukishima ..... 440/89

5,009,622 4/1991 Dudney ..... 440/88

*Primary Examiner*—Robert J. Oberleitner
*Assistant Examiner*—Clifford T. Bartz
*Attorney, Agent, or Firm*—G. Turner Moller

[57] ABSTRACT

A two cycle or four cycle outboard motor is equipped with a closed circuit cooling system having a coolant pump, a heat exchanger, an expansion tank, a series of coolant passages in the motor and some external piping to complete the circuit. In one embodiment of the invention, a conventional outboard motor is modified to include the closed circuit coolant system with the conventional water pump being converted to the coolant pump. In this modified embodiment, the thermostat seals have to be modified, the pump has to be sealed, and several bypass holes have to be plugged in the engine to isolate the flow of coolant.

17 Claims, 5 Drawing Sheets

OUTBOARD MOTOR COOLING SYSTEM

This application is a continuation of application Ser. No. 08/015,141 filed Feb. 9, 1993, now abandoned; which was a continuation of application Ser. No. 07/625,003, filed Dec. 10, 1990, now abandoned; which was a continuation-in-part of application Ser. No. 07/481,249, filed Feb. 20, 1990, now abandoned.

This invention relates to an outboard motor cooling system and more particularly to a closed circuit coolant system.

All presently available outboard motors are cooled by a positive loss or one-time-through cooling system. Cool water passes through an inlet on the propeller or jet drive unit below the water line to a pump located in the lower unit. The coolant water is pumped upwardly through water passages in the lower unit to the engine block and heads where heat is transferred to the cool water. Heated water then passes through a thermostat and is delivered downwardly through coolant passages into exhaust gas passages in the lower unit to a discharge at or under the water line on the propeller or jet drive unit. These systems have become the only type coolant system used in outboard motors because they have cooled well and are inexpensive to build and maintain. As a rule, they are the essence of simplicity and, other than the water passages, have only three components—the water pump and one or two thermostats.

Some very early outboard motors used the gears in the propeller drive unit as a pump to propel coolant water up into the engine. There are a number of problems with such systems, some of which are that coolant water removes lubricant from the drive gears and delivers sand or other abrasives to the drive gears. The industry response to such problems was to provide a separate coolant pump and the practice of using the propeller drive gears as a pump stopped. Thus, modern outboard motors include a pump driven by the output of the engine and a separate drive unit, either a right angle propeller drive unit or a jet drive unit in which the propulsive mechanism is a pump impeller.

There are two major problems with modern positive loss coolant systems. The first is corrosion. In salt water environments, the circulated coolant water is obviously salt water. Ultimately, a corrosion spot develops on one of the water passages inside the engine. Sooner or later, the corrosion spot becomes a hole or a blockage, water flow is disrupted, the engine overheats, a piston galls in the cylinder, the piston rod breaks and pokes through the cylinder wall and the engine is junk. This is the most common process of ruining an outboard motor.

The second problem with positive loss coolant systems is that, in very shallow water situations, the motor is raised to raise the propeller. Occasionally, the coolant water inlet is raised partially above the water line causing the pump to cavitate and lose suction thereby disrupting water circulation. It is believed that the life expectancy of new outboard motors on very shallow draft boats is short. This is aggravating to the manufacturer because the only thing that is apparent after the fact is that the engine overheated and the head is warped.

U.S. Pat. No. 1,446,775 discloses a very early outboard motor having a combined cooling and lubrication system in which coolant/lubricant is circulated through the lower unit and then through a water jacket around the cylinder. Also of interest relative to this invention are the disclosures in U.S. Pat. Nos. 3,242,914; 3,452,701; 4,689,025 and 4,749,374.

In accordance with this invention, a closed cooling system is provided for a two cycle or four cycle outboard motor. In a preferred embodiment, a more-or-less conventional modern two cycle outboard motor is modified to provide a closed cooling system comprising, in circuit, a coolant pump, coolant passages in the lower unit and engine, a reservoir and a heat exchanger. The coolant pump is preferably the standard water pump located in the lower unit at the top of the drive unit. Some work has to be done inside the engine to isolate the coolant passages for a preferred embodiment of this invention. The heat exchanger may be of the water cooled type mounted on the motor or on the boat at a location below the water line or may be an air cooled type analogous to an automotive radiator. Coolant water flows through the heat exchanger as the boat travels through the water. When the motor is idling, there is little heat generation and little heat transfer across the heat exchanger. Happily, when the motor is running hard and generating a large quantity of heat, the boat is moving in the water and a great deal of heat is transferred across the heat exchanger.

In another embodiment of the invention, a four cycle outboard motor is modified to provide a closed circuit cooling system separate and independent of the closed lubrication system.

In summary, one aspect of this invention comprises an outboard motor comprising an internal combustion engine including a block providing a coolant passage therein, a shaft output and a lower unit, in driven relation with the output, having a drive unit and means for lubricating the drive unit; and a closed circuit cooling system independent of the lubricating means including, in circuit, a coolant pump, a heat exchanger and the coolant passage for conducting coolant between the coolant pump, heat exchanger and coolant passages for cooling the engine.

In summary, another aspect of this invention comprises an outboard motor comprising an internal combustion engine including a block providing a plurality of cylinders and a coolant passage in heat receiving relation with the cylinders, a shaft output, a lower unit having an exhaust gas outlet and a drive unit in driven relation with the output, and means for receiving exhaust gases from the cylinders and delivering exhaust gases to the exhaust gas outlet; a first closed circuit cooling system including, in circuit, a coolant pump, a heat exchanger and the coolant passage for conducting coolant between the coolant pump, heat exchanger and coolant passages for cooling the engine; and a second one-time-through cooling system including an inlet, a discharge outlet in communication with the exhaust gas receiving and delivering means and means for conducting coolant water from the inlet to the discharge outlet.

One object of this invention is to provide an improved cooling system for an outboard motor.

Another object of this invention is to provide a closed cooling system for an outboard motor.

A further object of this invention is to provide a closed cooling system for an outboard motor including a heat exchanger located below the water line and a separate one-time-through cooling system for cooling exhaust gases.

Other objects and advantages of this invention will become more fully apparent as this description proceeds, reference being made to the accompanying drawings and appended claims.

IN THE DRAWINGS

Figure 1:
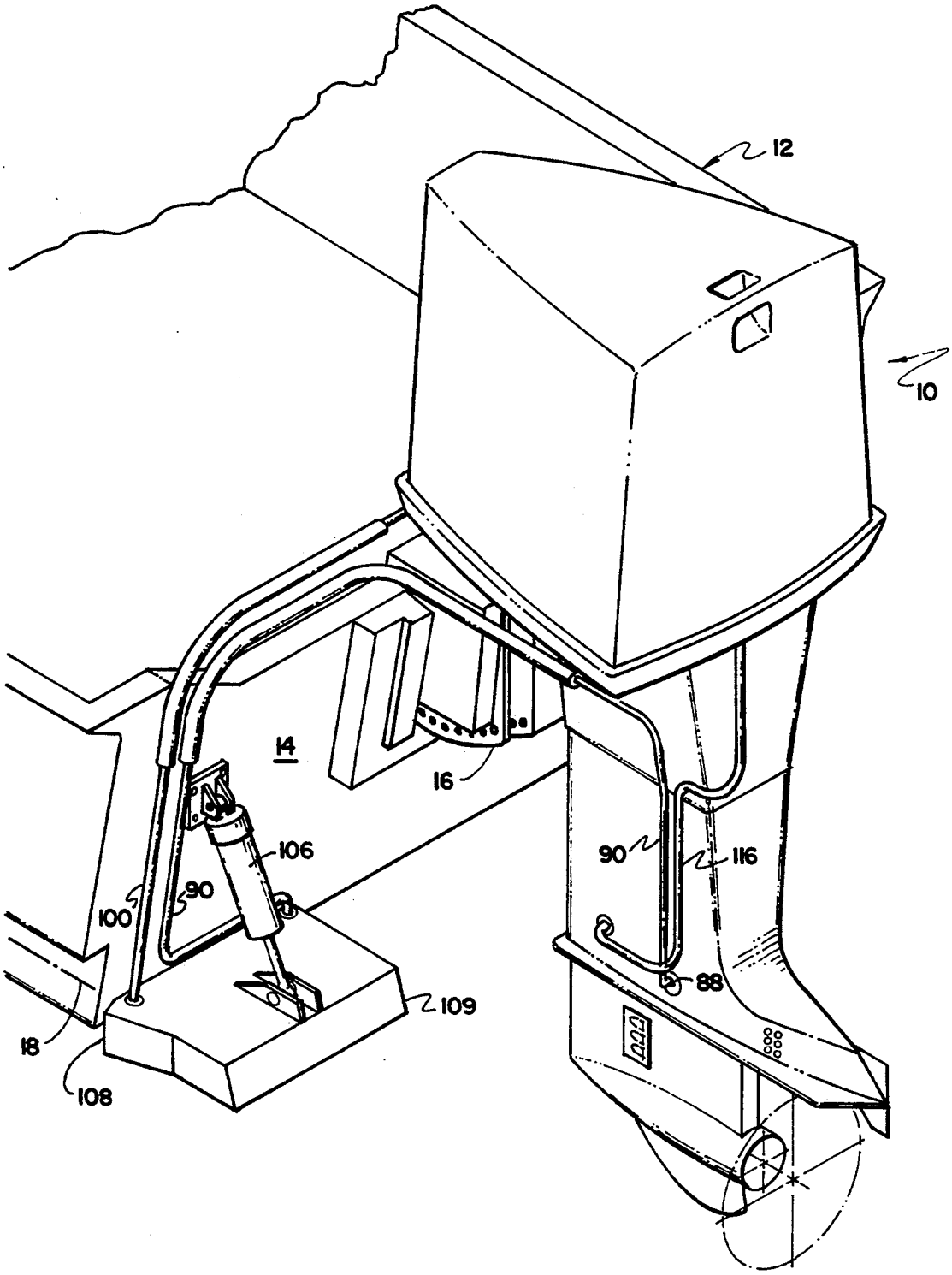
FIG. 1 is an isometric view of a boat and outboard motor equipped with the cooling system of this invention.
Figure 2:
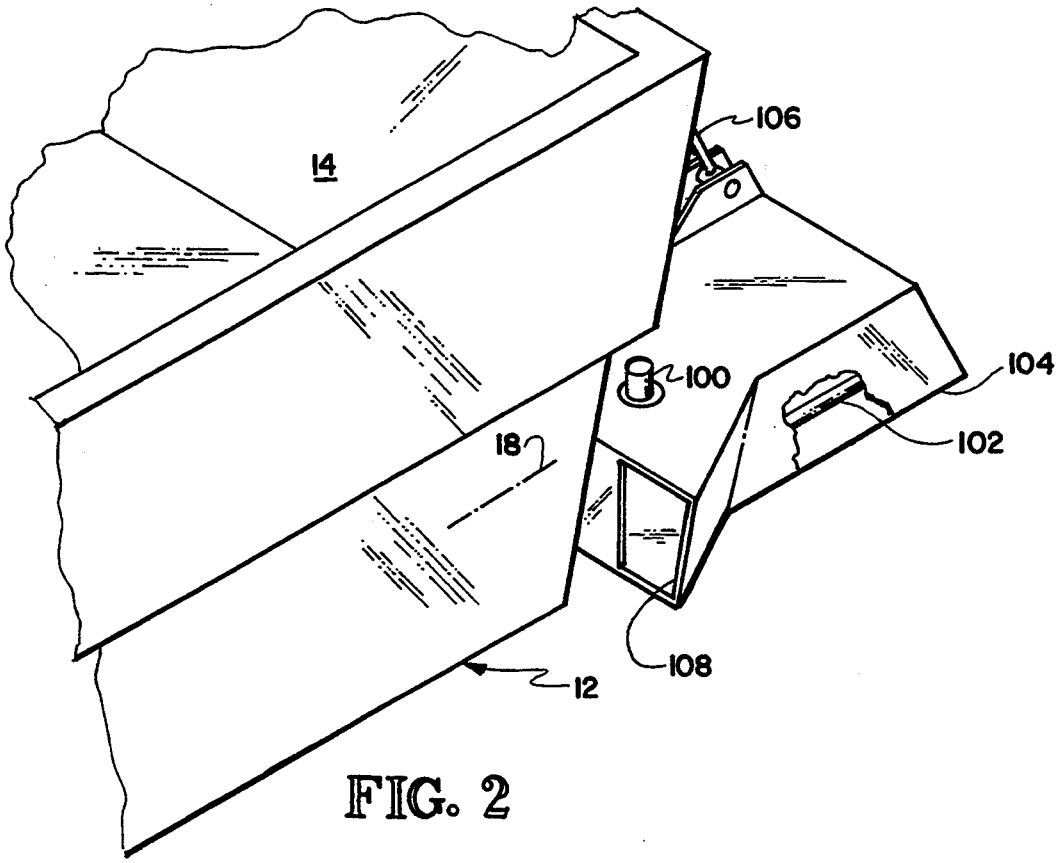
FIG. 2 is another isometric view of the boat of FIG. 1, illustrating the cool water inlet to the heat exchanger.
Figure 3:
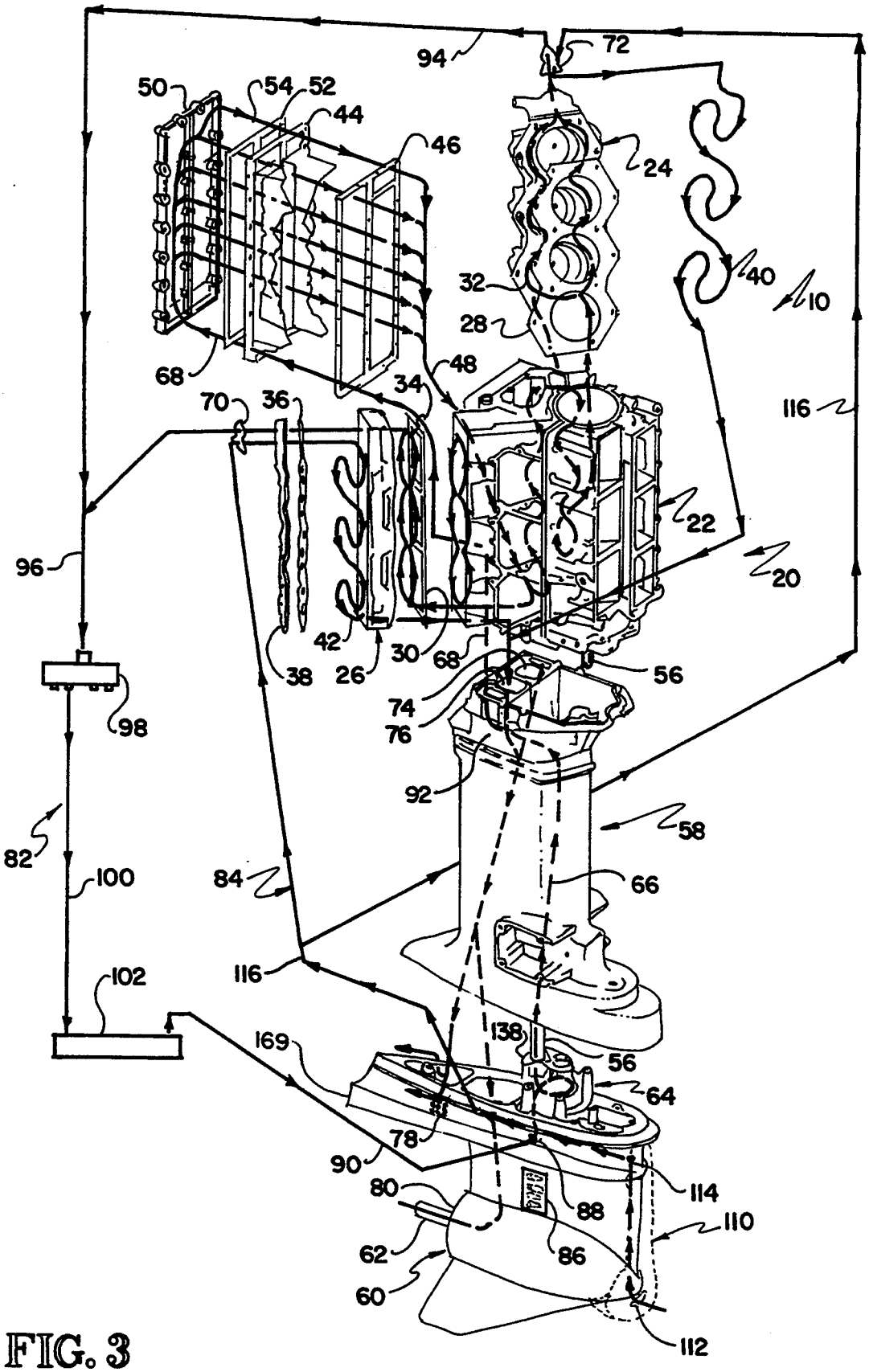
FIG. 3 is an exploded isometric view of a modified conventional two cycle outboard motor showing the coolant flow paths of this invention.

Referring to FIGS. 1–3, there is illustrated an outboard motor 10 of this invention mounted on the back of a boat 12. The boat 12 is wholly conventional having a generally upstanding stern end 14 on which the motor 10 is mounted by a mechanism 16 which allows the motor 10 to be raised and lowered relative to the boat 12. This arrangement is typical of boats and motors equipped for shallow water operation where there is a particular danger of overheating the motor 10 when a conventional water inlet is raised above a water line 18.

As shown best in FIG. 3, the outboard motor 10 includes a conventional two cycle internal combustion engine 20 having a block 22. The engine 20 is illustrated as being of V-6 construction including a pair of heads 24, 26 sealed to the block by head gaskets 28, 30 to provide a pair of tortuous coolant flow paths 32, 34 between the heads 24, 26 and the block 22.

Present heads are aluminum castings having an elaborate shape facing away from the block 22 with a gasket 36 and cover 38 closing the outer face of the heads 24, 26 to provide a tortuous coolant flow path 40, 42 between the heads 24, 26 and the covers 38. Similarly, the block 22 provides, between the cylinder ports, an outwardly facing elaborate shape closed by an inner exhaust cover 44 and gasket 46 to provide a plurality of tortuous flow paths 48 between the inner exhaust cover 44 and the block 22. An outer exhaust cover 50 and gasket 52 close the top of the inner exhaust cover 44 and provide elaborate flow passages 54 which ultimately communicate with the passages 48.

The block or power head 22 includes a plurality of cylinders and pistons (not shown) driving a crankshaft (not shown) providing a shaft output 56 extending partially through a lower unit 58 into a drive unit 60 which is illustrated in FIG. 3 as a right angle propeller drive unit but which may be a jet drive. The lower unit 58 is accordingly attached to the block 22. A gear reducer (not shown) in the drive unit 60 is in driven engagement with the output shaft 56 to drive the propeller shaft 62. The propeller drive unit 60 is conventional and is sealed and includes a quantity of lubricant therein which is distributed over the gear reducer (not shown) by a splash system.

In a conventional outboard motor, a coolant pump 64 sits on top of the drive unit 60 and is driven by the shaft 56 to deliver water through a coolant passage 66 extending upwardly through the lower unit 58. The coolant passage 66 communicates with a coolant passage 68 leading to the outer exhaust cover 50 and thus communicates with the coolant passage 54. The coolant passage 54 winds its way through the block 22 and communicates with the coolant passages 32, 34 between the heads 24, 26 and the block 22. Those skilled in the art will recognize the motor 10, as heretofore described, as being exemplary of a conventional modern outboard motor. More particularly, FIG. 3 is taken from a water flow diagram of an Outboard Marine Corporation brochure showing a 1976 model V-6 two cycle outboard developing 150, 175 or 200 horsepower.

In a standard outboard motor, openings in the head covers 38 and thermostats direct flow from the passages 32, 34 into the water passages 40, 42. The water passages 40, 42 communicate separately with a vertical exhaust gas passages 74, 76 at the junction of the lower unit 58 and the block 22. Exhaust gases from the engine 22 flow into the passages 74, 76 and are cooled by water from the passages 40, 42. The exhaust gas passages 74, 76 communicate inside the lower unit 58 and connect to a pair of outlets 78 on the sides of the drive unit 60 and to an outlet 80 adjacent the propeller shaft 62. In a standard outboard motor, all of the coolant water pumped upwardly through the lower unit 58 circulates through the block 22 and heads 24, 26 and exits along with exhaust gases through the outlets 78, 80.

Figure 5:
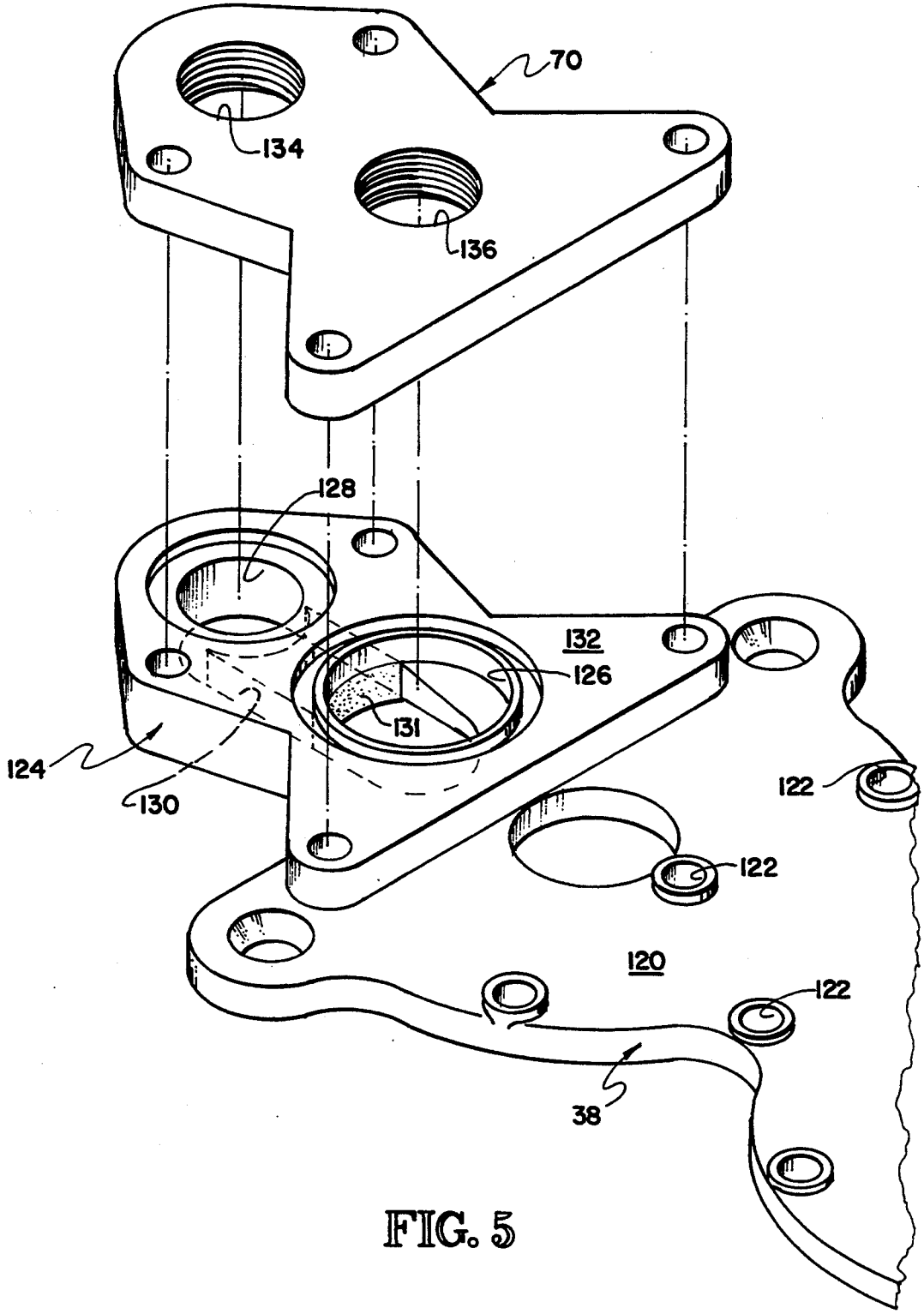
FIG. 5 is an enlarged exploded partial isometric view of a modified thermostat cover.

As shown in FIG. 3, the standard water flow pattern in the outboard motor 10 has been modified in several respects to provide a first closed circuit cooling system 82 and a second positive loss or one-time-through cooling system 84. To these ends, the conventional water intake, in the area 86, has been closed in any suitable fashion, as by filling with fiberglass, epoxy or the like. An intake opening 88 has been drilled and tapped to receive piping 90. The pump 64 has been provided with seals on the inlet and outlet ends to prevent water loss from the closed system 82. Bypass holes in lower unit 58 communicating between the passage 66 and the passages 74, 76 have been closed in the upper end of the lower unit in the area 92. The thermostat covers 70,72 have been modified along with the head cover 38 as shown in FIG. 5 to separate the first and second cooling systems 82, 84, as more fully explained hereinafter.

Figure 4:
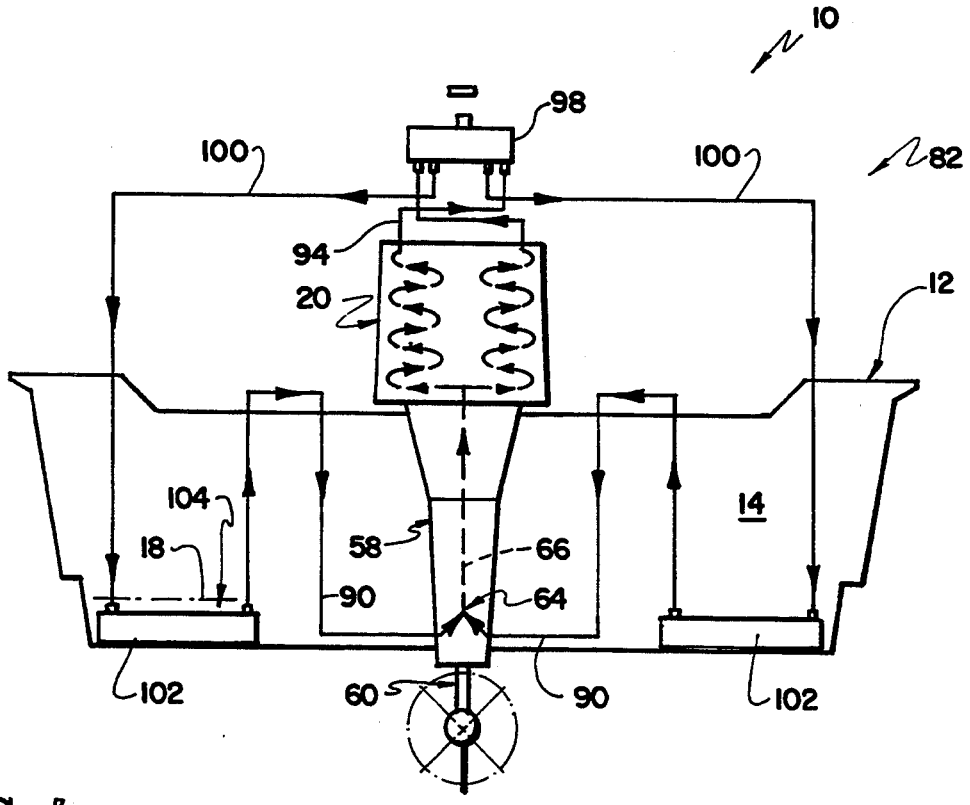
FIG. 4 is a schematic flow diagram of the closed circuit cooling system of this invention.

As shown more completely in FIG. 3 and more schematically in FIG. 4, the closed circuit cooling system 82 thus includes an elaborate cooling path through the motor 10 having a first segment including the vertical passage 66 in the lower unit 58, the coolant passage 68 leading to the outer and inner exhaust covers 50, 44 and the coolant passage 48 leading to the block 22. Coolant coming out of the block 22 passes through parallel second segments including the passages 32, 34 and the thermostat covers 70, 72 and then through passages 94, 96 to an expansion tank 98. The tank 98 is connected by piping 100 to one or more heat exchangers 102 which is connected by piping 90 to the inlet opening 88 communicating with the pump 64. Thus, there is provided a fresh water cooling system for the motor 10 thereby substantially eliminating corroding through one of the coolant passages in the block 22 and also eliminating overheating due to raising the motor 10 out of the water in an attempt to pass through shallow water.

The heat exchanger 102 may be of any suitable type such as a shell and tube arrangement and, in the embodiment of FIGS. 1–4, is mounted on the stern end 14 of the boat 12 preferably inside a trim tab 104. The trim tab 104 is preferably pivotally mounted on the boat 12 and includes a hydraulic motor 106 to tilt the trim tab 104 on the command of the boat operator. The trim tab 104 preferably includes a scoop 108 on the forward end thereof directing water across the heat exchanger 102 to exit through an opening on the side 109 of the trim tab 104.

Referring to FIG. 3, the second cooling system 84 uses water from adjacent the motor 10 as the coolant and includes a scoop 110 having a forwardly facing inlet opening 112 and an outlet opening 114 connecting to piping 116 leading to the thermostat covers 70, 72. Although the scoop 110 is illustrated as being on the lower drive unit, it may be mounted on the bottom of the boat 12 and connected to the opening 112 by a hose. The cooling system 84 is separate from the cooling system 82 so water flows into the flow passages 40, 42 between the heads 24, 26 and covers 38 and exits into the exhaust gas passages 74, 76 to cool the exhaust gases. The coolant water of the second cooling system 84 exits the motor through the openings 78 80. Circulation through the second cooling system 84 is caused by movement of the boat 12 forcing ambient water through the scoop 110 and motor 10. When the motor 10 is idling and the boat 12 is not moving, little heat is produced and the closed circuit cooling system 82 is adequate to cool the engine. When the motor 10 is running hard, there is sufficient circulation through the system 84 to assist cooling the motor 10 and particularly to cool the exhaust gases passing through the passages 74, 76.

FIG. 5 is an enlarged isometric view of one end of the head cover 38 comprising an aluminum casting 120 having a plurality of holes 122 to receive bolts (not shown) connecting the cover 38 to the head 26. The end 124 of the cover 38 includes a first passage 126 communicating with a passage (not shown) in the head immediately below the passage 126 and a second passage 128 communicating with a passage (not shown) in the head immediately below the passage 128. A bypass 130 communicates between the passages 126, 128. In a standard outboard motor, water flow is through the passage 34 from the underside of the head into the opening 128 in the housing 70, then through the bypass opening 130 and past a thermostat valve (not shown) in the passage 126 and then into the passage 42. In the outboard motor of this invention, the standard thermostat cover (not shown) is removed and the bypass 130 is closed, as by filling the bypass 130 with epoxy 131 or the like thereby separating flow through the passage 34 from flow through the passage 42. A new thermostat cover 70 and gasket (not shown) are provided to seal the upper face 132 of the cover end 124. The thermostat cover 70 includes a first threaded opening 134 having a fitting (not shown) connected to the conduit 96 and a second threaded opening 136 having a fitting (not shown) connected to the piping 116. Thus, plugging the bypass 130 and providing separate outlets from the thermostat cover 70 separates the cooling system 82 from the cooling system 84.

One of the oddities of outboard motor cooling systems is that the coolant pump is not sealed, i.e. water loss is allowed on the periphery of the shaft extending through and driving the pump rotor Because the material being pumped is the same on the inside of the pump as on the outside and there is plenty of capacity, there is no reason to pay the costs of sealing the drive shaft to the pump housing. This is not true in this invention because loss of the fresh water-glycol coolant through the pump housing ultimately depletes the source of coolant. Thus, the water pump housing 138 is modified to provide a seal against the periphery of the drive shaft 56.

Figure 6:
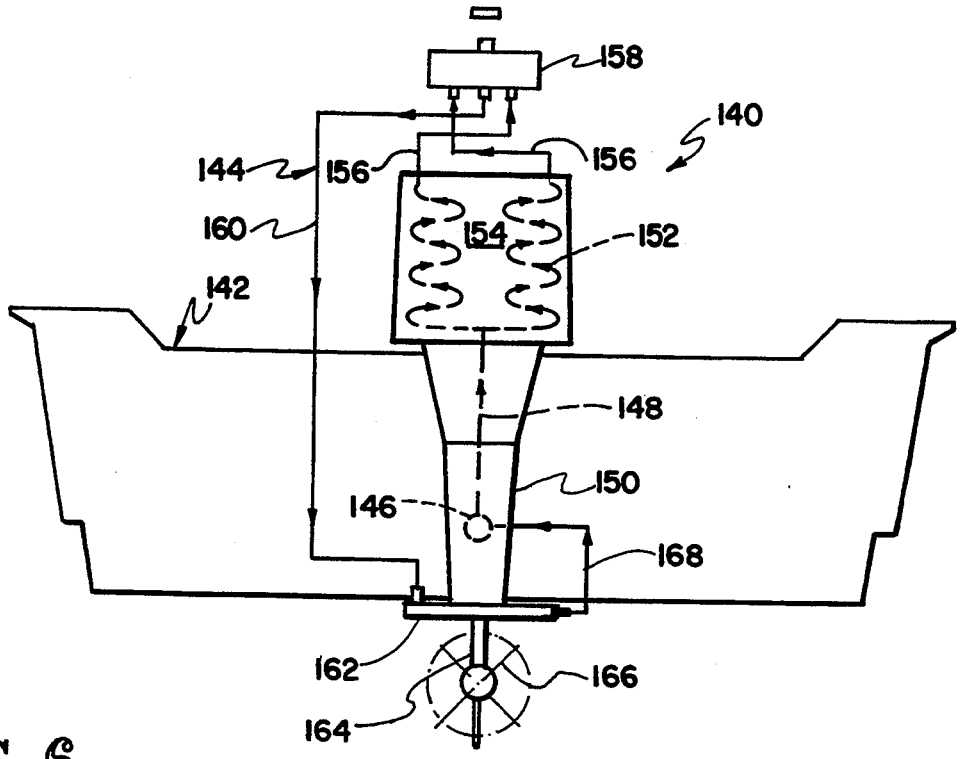
FIG. 6 is a schematic flow diagram of another embodiment of the motor of this invention.

Referring to FIG. 6, there is schematically illustrated another embodiment of this invention comprising an outboard motor 140 mounted on the rear of a boat 142 and having a closed circuit cooling system 144 comprising a coolant pump 146, a vertical passage 148 through a lower unit 150 and a pair of parallel passages 152 extending upwardly through the engine block 154 exiting through a pair of conduits 156 into an expansion reservoir 158. A conduit 160 connects the reservoir 158 to the inlet of a heat exchanger 162 carried on the lower unit 150 immediately above the drive unit 164 which is illustrated as being of the right angle propeller drive type having a propeller 166 but which may be a jet drive unit. The heat exchanger 162 includes an outlet connected by piping 168 to the inlet of the pump 146. Thus, the heat exchanger 162 may be mounted on the fairing 169 shown in FIGS. 1 and 3.

Figure 7:
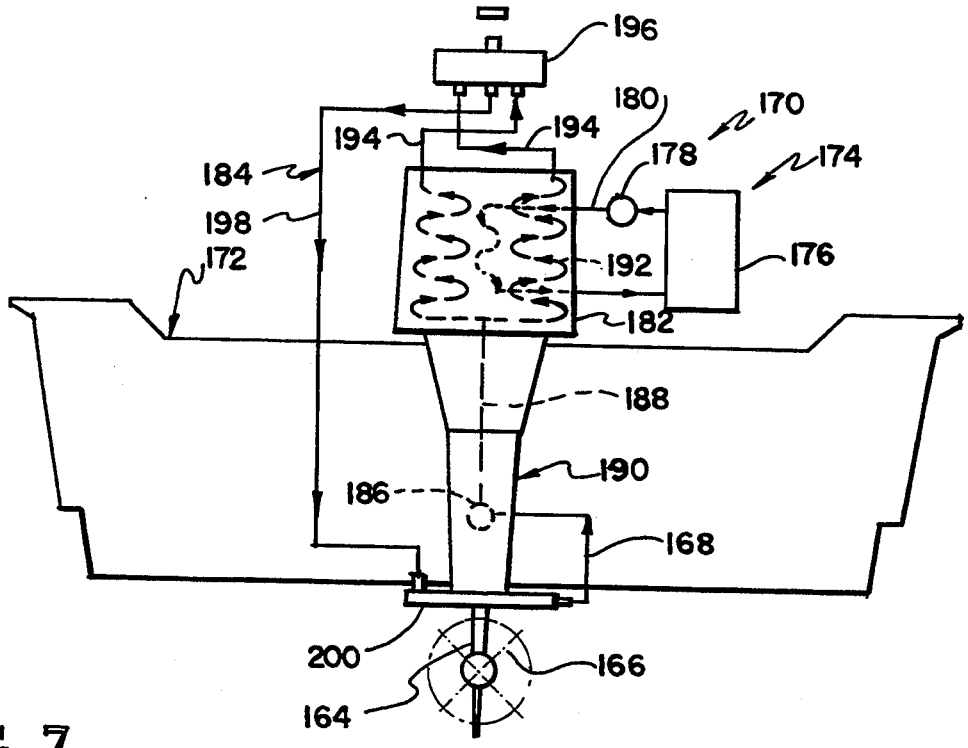
FIG. 7 is a schematic flow diagram of another embodiment of this invention comprising a modified four cycle outboard motor.

Referring to FIG. 7, there is schematically illustrated another embodiment of this invention comprising a four cycle outboard motor 170 mounted on the rear of a boat 172 and having a closed circuit lubrication system 174 including a sump 176, an oil pump 178 and oil flow passages 180 leading through the engine block 182 and back to the sump 176 in a conventional manner. The conventional four cycle outboard motor 170, as heretofore described, is modified to provide a closed circuit cooling system 184 comprising a coolant pump 186, a vertical passage 188 through a lower unit 190 and a pair of parallel passages 192 extending upwardly through the engine block 182 exiting through a pair of conduits 194 into an expansion reservoir 196. A conduit 198 connects the reservoir 196 to the inlet of a heat exchanger 200 located on either the boat 172 or the motor 170. The lubrication system 174 and cooling system 184 are thus independent of one another.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An outboard motor of the type comprising an internal combustion engine including a block providing a coolant passage therein, and a shaft output; and a lower unit, in driven relation with the output, having a drive unit, and means for lubricating the drive unit; means providing an exhaust gas passage from the engine through the lower unit; and a first one-time-through cooling system delivering ambient water through the engine and through the exhaust passage and including a coolant pump, the improvement comprising means converting the first one-time-through cooling system into a closed circuit cooling system and a second one-time-through cooling system, the closed circuit cooling system being independent of the lubricating means and including, in circuit, the coolant pump, a heat exchanger and the block coolant passage for conducting coolant between the coolant pump, heat exchanger and coolant passage for cooling the engine;

the second one-time-through cooling system being independent of the closed circuit cooling system and comprising an inlet, a discharge outlet in communication with the exhaust gas passage and means for conducting water from the inlet to the outlet.

2. The outboard motor of claim 1 wherein the second one-time-through cooling system inlet is on the drive unit.

3. The outboard motor of claim 1 wherein the lower unit provides a lower unit coolant passage extending upwardly to the block in communication with the block coolant passage and the coolant pump is located in the lower unit having an inlet and having a discharge in communication with the lower unit coolant passage and wherein the closed circuit cooling system includes conduit means external of the lower unit connecting the heat exchanger and the coolant pump inlet.

4. The outboard motor of claim 1 wherein the closed circuit cooling system includes a thermostat housing attached to the engine providing a first communication path between the block coolant passage and the heat exchanger, the thermostat housing providing a second communication path, separate from the first communication path, comprising part of the means for conducting water from the inlet to the outlet.

5. The outboard motor of claim 4 wherein the engine includes a head attached to the block and providing a coolant passage and the means for conducting coolant water from the inlet to the discharge outlet includes the head coolant passage, the head coolant passage being connected between the second communication path and the discharge outlet.

6. An outboard motor comprising an internal combustion engine including a block providing a plurality of cylinders and a coolant passage in heat receiving relation with the cylinders, and a shaft output;

a lower unit having an exhaust gas outlet, a drive unit in driven relation with the output and means for receiving exhaust gases from the cylinders and delivering exhaust gases to the exhaust gas outlet;

a first closed circuit cooling system including, in circuit, a coolant pump, a heat exchanger, a housing attached to the block and the coolant passage for conducting coolant between the coolant pump, heat exchanger and coolant passage for cooling the engine, the housing providing a first communication path between the block coolant passage and the heat exchanger; and a second one-time-through cooling system including an inlet, a discharge outlet in communication with the exhaust gas receiving and delivering means and means for conducting coolant water from the inlet to the discharge outlet including a conduit external of the lower unit connected to the inlet and to a second communication path provided by the housing, the second communication path being separate from the first communication path.

7. The outboard motor of claim 6 wherein the engine includes a head attached to the block and providing a coolant passage and the means for conducting coolant water from the inlet to the discharge outlet includes the head coolant passage, the head coolant passage being connected between the second communication path and the discharge outlet.

8. The outboard motor of claim 6 wherein the housing is a thermostat housing.

9. The outboard motor of claim 6 wherein the inlet of the second one-time-through cooling system is on the drive unit.

10. An outboard motor comprising an internal combustion engine including a block providing a coolant passage therein, and a shaft output;

a lower unit, in driven relation with the output, having a drive unit and an exhaust gas passage from the engine;

means for cooling the engine block comprising a closed circuit cooling system including in circuit, a coolant pump, a heat exchanger and the coolant passage for conducting coolant between the coolant pump, heat exchanger and coolant passage for cooling the engine; and means for cooling the lower unit including a one-time-through cooling system independent of the closed circuit cooling system comprising an inlet, a discharge outlet in communication with the exhaust gas passage and means for conducting water from the inlet to the outlet.

11. The outboard motor of claim 10 wherein the closed circuit cooling system includes therein a water based coolant.

12. The outboard motor of claim 10 wherein the engine includes a head attached to the block and providing a coolant passage and the means for conducting coolant water from the inlet to the outlet includes the head coolant passage.

13. An outboard motor comprising an internal combustion engine including a block providing a plurality of cylinders and a coolant passage, in heat receiving relation with the cylinders, a lubrication system, and a shaft output;

a lower unit having an exhaust gas outlet, a drive unit in driven relation with the output and means for receiving exhaust gases from the cylinders and delivering exhaust gases to the exhaust gas outlet;

a first closed circuit cooling system independent of the lubrication system including, in circuit, a coolant pump, a heat exchanger and the block coolant passage for conducting coolant between the coolant pump, heat exchanger and block coolant passage for cooling the engine; and a second one-time-through cooling system including an inlet, a discharge outlet in communication with the exhaust gas receiving and delivering means and means for conducting coolant water from the inlet to the discharge outlet.

14. The outboard motor of claim 13 wherein the first cooling system includes therein a water based coolant.

15. The outboard motor of claim 13 wherein the engine includes a head attached to the block and providing a coolant passage and the means for conducting coolant water from the inlet to the outlet includes the head coolant passage.

16. An outboard motor comprising an internal combustion engine including a block providing a plurality of cylinders and a coolant passage in heat receiving relation with the cylinders, a head having a coolant passage therein, a lubrication system, and a shaft output;

a lower unit having an exhaust gas outlet, a drive unit in driven relation with the output and means for receiving exhaust gases from the cylinders and delivering exhaust gases to the exhaust gas outlet;

a first closed circuit cooling system independent of the lubrication system including, in circuit, a coolant pump, a heat exchanger and one of the coolant passages for conducting coolant between the coolant pump, heat exchanger and the one coolant passage; and a second one-time-through cooling system including an inlet, a discharge outlet in communication with the exhaust gas receiving and delivering means and means including the other coolant passage for conducting coolant water from the inlet to the discharge outlet.

17. The outboard motor of claim 16 wherein the block coolant passage is in the closed circuit cooling system and the head coolant passage is in the one-time-through cooling system.

* * * * *